United States Patent [19]

Pflum

[11] Patent Number: 5,000,255

[45] Date of Patent: Mar. 19, 1991

[54] FLUIDIZED BED HEAT EXCHANGER

[75] Inventor: David Pflum, Ames, Iowa

[73] Assignee: Applied Thermodynamic Systems, Ames, Iowa

[21] Appl. No.: 548,489

[22] Filed: Jul. 3, 1990

[51] Int. Cl.[5] ..... F28C 3/12

[52] U.S. Cl. ..... 165/104.16; 165/104.18; 422/146

[58] Field of Search ..... 165/104.16, 104.18; 422/146

[56] References Cited

U.S. PATENT DOCUMENTS

| | | | |
|---|---|---|---|
| 3,902,550 | 9/1975 | Martin | 165/104.16 |
| 4,296,800 | 10/1981 | Johnson | 165/104.16 |
| 4,398,594 | 8/1983 | Klaren | 422/146 |
| 4,403,650 | 9/1983 | Klaren | 422/146 |

FOREIGN PATENT DOCUMENTS

| | | | |
|---|---|---|---|
| 3432864 | 3/1986 | Fed. Rep. of Germany | 165/104.16 |

*Primary Examiner*—Albert W. Davis, Jr.
*Attorney, Agent, or Firm*—Kent A. Herink

[57] ABSTRACT

An improved heat exchanger for the transfer of heat between a first and second fluid includes a shell enclosure, tube means, fluidized bed of particles, and a distributor plate. The first fluid is passed through the shell. Tubes positioned in the shell contain the bed particles through which the second fluid passes so as to fluidize the bed of particles. Heat is transferred between the fluids. The fluidized particles enhance heat transfer and mitigate the deposition of material on the tube walls.

5 Claims, 2 Drawing Sheets

FLUIDIZED BED HEAT EXCHANGER

BACKGROUND OF THE INVENTION

1. Field of Invention

This invention relates to heat exchangers, and more specifically, to an improved fluidized bed heat exchanger.

2. Background of the Art

A common method of exchanging heat between fluids is to position an enclosure of one of the fluids within an enclosure of the other fluid. By directing the fluids through their respective enclosure, heat is transferred from the hotter fluid to the colder fluid.

It is known that heat transfer can be enhanced by fluidizing a bed of particles in one or both of the enclosures. It is also known that the fluidized bed of particles acts as a scouring agent, and prevents the formation of deposits on the enclosures containing the fluidized bed. Deposits on the enclosures are undesirable as they impede the transfer of heat between the fluids.

Some disadvantages are associated with the addition of a fluidized bed of particles. The bed of particles can limit the range of allowable fluid velocities in the enclosures. The bed of particles can be the source of severe wear on the enclosures. The bed of particles can induce flow patterns which reduce the efficiency of heat exchange between the two fluids.

Therefore, it is a principal object of the invention to provide a heat exchanger means and method which improves the art.

A further object of the invention is to provide a means and method to allow the heat exchanger to operate with a wider range of fluid velocities.

A further objective of the inventions is to provide a means by which erosion of the heat exchanger enclosures by the bed particles is reduced or eliminated.

A further object of the invention is to provide a means by which flow patterns detrimental to heat transfer are not induced.

Another object of the invention is to provide a means by which the advantages of the fluidized bed of particles, namely the prevention of fouling deposits on the enclosures of the heat exchanger and the enhancement of heat transfer between the fluids, can be utilized more economically and with less complexity.

These and other objects and advantages of the invention will become more apparent in the accompanying specification and claims.

SUMMARY OF THE INVENTION

The present invention is an apparatus and method for enhanced heat transfer between two fluids. The invention centers on improving prior art in fluidized bed heat exchangers by providing for improved distributor plate design. A shell enclosure having a first fluid inlet and a first fluid outlet is provided. A first fluid is directed through a shell enclosure. A plurality of tubular containers are positioned in the shell and each tube contains bed particles supported on a distributor plate. Each tube has a second fluid inlet and outlet. The inlets and outlets can be connected to a common header. A second fluid is directed through the tubes at a velocity sufficient to fluidize the bed particles. A heat transfer interface is generally described as the fluidized bed portions of the tubes and the co-extensive portion of the shell area. The fluidized bed enhances heat transfer on the tube side and also acts to prevent formation of deposits on the tube walls. Such deposits inhibit heat transfer and reduce the efficiency of the heat exchanger.

The present invention is adaptable to create an improved fluidized bed heat exchanger due to the design and positioning of the particle distributor plate. The distributor plate enhances particle circulation allowing for the fluid velocity passing through the bed to be widely variable. The distributor plate inhibits bed material from entering the second fluid inlet area were it could be entrained in flow eddys, causing erosion of the shell. The simple yet effective design of the distributor plate provides for a more economical heat exchanger. Different sizes and types of bed particles can be used depending on the density and viscosity of the second fluid. Also, the flow of the first and second fluids can be adjusted to vary the rate of heat transfer.

DETAILED DESCRIPTION OF A PREFERRED EMBODIMENT

Figure 1:
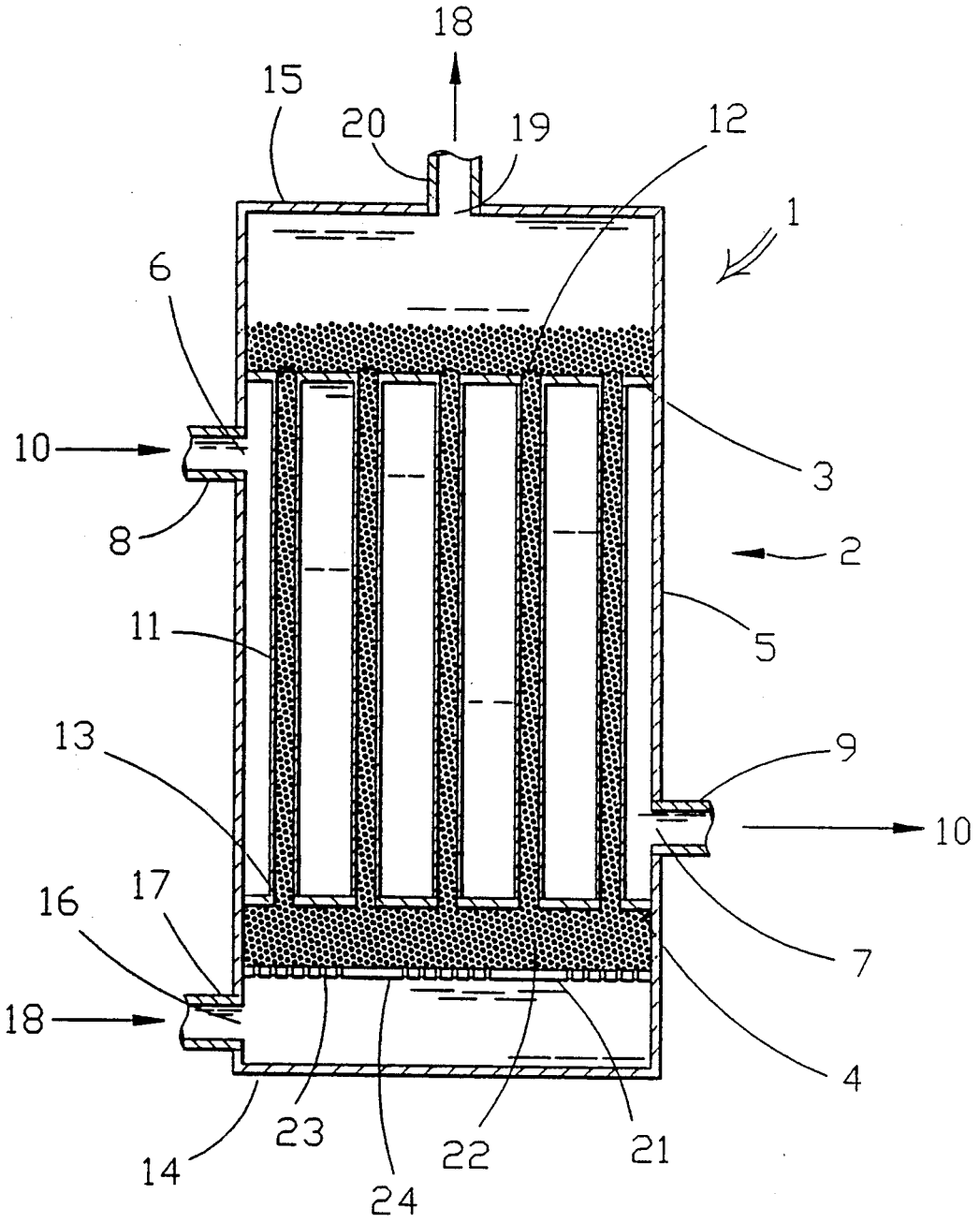
FIG. 1 is an elevational sectional view of one embodiment of the heat exchanger.

With reference to the accompanying drawings, a preferred embodiment of the invention will now be described. Most elements of the preferred embodiment will be designated by reference numerals, as indicated on FIG. 1.

FIG. 1 depicts, in elevated cross-section, the heat exchanger 1. The shell enclosure 2 is defined by a top wall 3, a bottom wall 4, and a continuous side wall 5.

The shell 2 is sealed except for an inlet 6 and an outlet 7, to which are connected an inlet conduit 8 and an outlet conduit 9, respectively. The inlet conduit 8 is connected to the source of the first liquid 10, and the outlet conduit 9 is connectable back to the source of the first liquid 10 or elsewhere. Also, the inlet conduit 8 and the outlet conduit 9 may be located in various regions of the shell, as desired.

A plurality of generally parallel vertically extended tubes 11 pass through the shell 2. Said tubes 11 may have smooth walls, may be grooved, or may be provided with fins on the inside or outside. The tubes 11 extend through a plurality of top wall openings 12, and through a corresponding plurality of bottom wall openings 13.

A tube inlet header 14 encloses the open inlet ends 13 of the tubes 11. A tube outlet header 15 encloses the open outlet ends 12 of the tubes 11. Both the tube inlet header 14 and the outlet header 15 provide a common chamber for distribution to and from the tubes 11, respectively.

An inlet 16 is connected to an inlet conduit 17, and is connectable to the source of the second fluid 18. A second fluid outlet 19 is connected to an outlet conduit 20, and provides a discharge means for the second fluid 18.

A distributor plate 21, consisting generally of a flat plate having small perforations 23 throughout, extends laterally through the shell 2 and abuts the side wall 5 thereof. The distributor plate 21 supports the bed particles 22 in tubes 11, yet is permeable by the second liquid 18 which enters the tube beds through the perforations 23.

To avoid shell erosion by the bed particles 23, it is advantageous to prevent passage of the bed particles 23 into the inlet header 14 where flow eddys exist. Therefore, the condition defined by the following inequality exists:

$$d_3 < d_p$$

where $d_p$ represents the diameter of the bed particles 22 and $d_d$ represents the diameter of the perforations 23 in the distributor plate 21.

The distributor plate 21 is positioned generally parallel to and below the bottom wall 4. Localized regions of high velocity of the second fluid 18 may exist above the perforations 23 in the distributor plate 21. To avoid erosion of bottom wall 4 by the bed particles 22 entrained in the high velocity regions, the distance, defined as h, between the bottom of bottom wall 4 and the top of distributor plate 21 should be greater than or equal to five times the diameter, $d_p$, of the bed particles 22. In other words, the following relation should exist: $h \geqq 5\ d_p$.

During operation of heat exchanger 1 with the velocity of the second fluid 18 being widely variable, the bed particles 22 may move upwardly through the tubes 11 and enter the tube outlet header 15. During this mode of operation it is advantageous if some bed particles 22 travel downward through one or more of tubes 11, creating a circulation pattern. It is, however, disadvantageous to allow the second fluid 18 to travel downward in any of tubes 11 as this creates a thermal short circuit, decreasing the efficiency of the heat exchanger.

Figure 2:
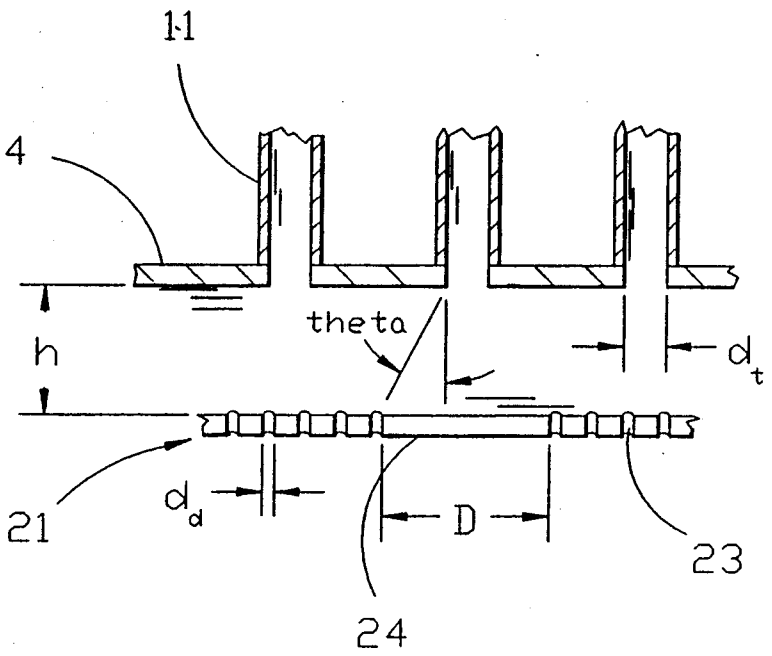
FIG. 2 is an enlarged elevational sectional view of the distributor plate region with parts broken away.

It is, accordingly, advantageous to lower the velocity of the second fluid 18 through one or more of tubes 11, allowing a portion of the bed particles 22 to travel downward, without creating downward flow of second fluid 18. To accomplish this, a circular region or regions 24 of the distributor plate 21 directly below one or more of tubes in which downward particle flow is desired should be devoid of the perforations 23 (FIG. 2). The diameter, D, of each region devoid of perforations is determined by:

$$D = d_t + 2 \times h \times \tan(\text{theta})$$

where, $d_t$ = outside diameter of tube(s) 11

$h$ = distance between bottom wall 4 and distributor plate 21

$0° < \text{theta} < 45°$

Fluidization causes agitation of the bed particles 22, which strike one another and the walls of tubes 11. This agitation enhances heat transfer in comparison to simple convection, and also acts to scour the surfaces of tubes 11, keeping them free of deposits.

The diameter and density of the bed particles 22 can be specifically selected depending on the type of fluid passing through the heat exchanger tubes. Also, the size and shape of shell 2 or tubes 11 can take on many variations.

It is to be understood that the preferred embodiment is shown for example only and is not to limit the scope of the invention as defined in the appended claims.

What I claim is:

1. An enhanced heat exchanger for transferring heat between two fluids, comprising:

a shell enclosure containing the first fluid and including an inlet and an outlet for said fluid;

one or more tubes forming an enclosure for the second fluid and containing a plurality of particles to be fluidized, and each of said tubes including an inlet and an outlet for the second fluid;

tube inlet header means open to said fluid inlets of said tubes and in fluid communication with a common second fluid source;

tube outlet header means open to said fluid outlet of said tubes and in fluid communication with a common outlet for the second fluid;

distributor plate means for supporting said particles that is permeable by the second fluid, and having a plurality of perforations each of which has a smaller diameter than the diameter of said particles, and which is generally parallel to and below the bottom of said inlets of said tubes, with distance between the top of said distributor plate and bottom of said tube inlets being greater than or equal to five times the diameter of said particles, wherein a circular region below said tubes in which a downward particle flow is desired is devoid of perforations, the diameter of said region of said distributor plate devoid of particles being:

$$D = d_t + 2 \times h \times \tan(\text{theta})$$

where, $d_t$ = oustside diameter of tubes $h$ = distance between said tube inlets and said distributor plate, and wherein the angle theta is greater than or equal to 0° but less than or equal to 45°.

2. The heat exchanger of claim 1 wherein the bed particles are glass beads and the second fluid is water.

3. The heat exchanger of claim 1 wherein the first fluid is undergoing a phase change.

4. The heat exchanger of claim 1 wherein the diameter of the particles is between 0.1 and 30 millimeters.

5. The heat exchanger of claim 1 wherein the distributor plate consists of a porous plate.

* * * * *